US009748056B2

(12) United States Patent
Tanoue et al.

(10) Patent No.: US 9,748,056 B2
(45) Date of Patent: Aug. 29, 2017

(54) ILLUMINATED-TYPE PUSH-BUTTON SWITCH AND KEYBOARD

(75) Inventors: Yasuhiro Tanoue, Shiga (JP); Masaki Sugihara, Okayama (JP)

(73) Assignees: OMRON Corporation, Kyoto (JP); Mitsubishi Electric Corporation, Tokyo (JP)

( * ) Notice: Subject to any disclaimer, the term of this patent is extended or adjusted under 35 U.S.C. 154(b) by 154 days.

(21) Appl. No.: 14/400,871

(22) PCT Filed: May 17, 2012

(86) PCT No.: PCT/JP2012/062705
§ 371 (c)(1),
(2), (4) Date: Nov. 13, 2014

(87) PCT Pub. No.: WO2013/171887
PCT Pub. Date: Nov. 21, 2013

(65) Prior Publication Data
US 2015/0114810 A1 Apr. 30, 2015

(51) Int. Cl.
*H01H 13/02* (2006.01)
*H01H 9/16* (2006.01)
*H01H 13/83* (2006.01)
*H01H 13/14* (2006.01)

(52) U.S. Cl.
CPC ..... *H01H 13/023* (2013.01); *H01H 9/161* (2013.01); *H01H 13/14* (2013.01); *H01H 13/83* (2013.01); *H01H 2219/036* (2013.01); *H01H 2219/06* (2013.01); *H01H 2219/062* (2013.01); *H01H 2219/0622* (2013.01)

(58) Field of Classification Search
CPC ..... H01H 13/02; H01H 13/20; G09F 13/04
USPC ..... 200/314, 310, 533
See application file for complete search history.

(56) References Cited

U.S. PATENT DOCUMENTS

2004/0022573 A1 2/2004 Yamauchi
2004/0256210 A1 12/2004 Morita et al.
2007/0058359 A1* 3/2007 Saitoh ..... G02B 5/045 362/97.3
2008/0055882 A1 3/2008 Ueno et al.

FOREIGN PATENT DOCUMENTS

CN 100529519 C 8/2009
JP H0940308 A 2/1997
(Continued)

OTHER PUBLICATIONS

International Search Report for corresponding International Application No. PCT/JP2012/062705, mailed Jul. 31, 2012 (4 pages).
(Continued)

*Primary Examiner* — Edwin A. Leon
*Assistant Examiner* — Iman Malakooti
(74) *Attorney, Agent, or Firm* — Osha Liang LLP

(57) ABSTRACT

A push-button switch (1) is arranged such that, once a user presses an operation button (8), a switch body (20) performs an operation, and light from an LED (21) passes through a transmission plate (70) and then illuminates the operation button (8). A structure (700) is provided on a lower surface (70*b*) of the transmission plate (70) to refract the light from the LED (21) so that the refracted light is reflected within the transmission plate (70) and then guided to an upper circumferential wall (71) of the transmission plate (70).

10 Claims, 21 Drawing Sheets

(56) References Cited

FOREIGN PATENT DOCUMENTS

| | | | | | |
|---|---|---|---|---|---|
| JP | 10-64358 | A | | 3/1998 | |
| JP | 2000-302347 | A | | 10/2000 | |
| JP | 2004-071258 | A | | 3/2004 | |
| JP | 2005-011672 | A | | 1/2005 | |
| JP | 2009-104844 | A | | 5/2009 | |
| JP | 2012-018917 | | * | 1/2012 | ..... H01H 13/02 |
| JP | 2012-18917 | A | | 1/2012 | |
| WO | 2006/011226 | A1 | | 2/2006 | |
| WO | WO2006/011226 | | * | 2/2006 | ..... B66B 1/46 |

OTHER PUBLICATIONS

Written Opinion for corresponding International Application No. PCT/JP2012/062705, mailed Jul. 31, 2012 (10 pages).
Office Action issued in Chinese Application No. 201110282761.7, mailed on Dec. 18, 2013 (20 pages).
Notification of Reasons for Refusal issued in Japanese Application No. 2013-078930, mailed on Jan. 28, 2014 (5 pages).
Decision to Grant a Patent issued in Japanese Application No. 2013-078930, mailed on May 27, 2014 (3 pages).
Decision to Grant a Patent issued in Japanese Application No. 2010-259222, mailed on Apr. 23, 2013 (3 pages).
Notification of Reasons for Refusal issued in Japanese Application No. 2010-259222, mailed on Feb. 5, 2013 (7 pages).
International Preliminary Report on Patentability issued in PCT Application No. PCT/JP2012-062705, mailed on Nov. 27, 2014 (5 pages).

* cited by examiner

ILLUMINATED-TYPE PUSH-BUTTON SWITCH AND KEYBOARD

CROSS-REFERENCE TO RELATED APPLICATION

This application is a National Stage of International Application No. PCT/JP2012/062705, filed on May 17, 2012. The contents of which are expressly incorporated herein by reference in their entirety.

TECHNICAL FIELD

The present invention relates to an illuminated push-button switch and an operating panel including the illuminated push-button switch.

BACKGROUND ART

The illuminated push-button switch is utilized as the followings: for example, an upward movement instruction switch and a downward movement instruction switch, both of which are intended for an elevator use and mounted into a wall surface of an elevator hall, and a door open instruction switch, a door close instruction switch, and a destination floor number instruction switch, all of which are mounted inside an elevator car. Typically, illuminated push-button switches employ a structure such that a switch body is actuated by a push displacement of an operation plunger with a press of an operating surface of a push button. The illuminated push-button switches further include illuminating means, using an LED (Light Emitting Diode) or the like light source, for displaying that the switch body has been actuated.

Recently, aesthetically designed illumination has been demanded of the illuminated push-button switches. For example, push-button switches described in Patent Literatures 1 and 2 cause light to illuminate not only the operating surface of the push button but also a surrounding part of the push button.

More specifically, the push-button switch described in Patent Literature 1 has an operation plunger with a tapered hole formed in the center thereof, so that light from the LED is reflected by surfaces forming the tapered hole and then guided to the surrounding part. Further, the illuminated push-button switch described in Patent Literature 2 has an operating section with an interior formed in a mortar shape. This arrangement allows light emitted by a light-emitting element to be bent at an inclined part which is provided inside of the operating section and then illuminate the surrounding part of the push button.

CITATION LIST

Patent Literature

[Patent Literature 1]

Japanese Patent Application Publication, Tokukai No. 2005-011672 (Publication date: Jan. 13, 2005)

[Patent Literature 2]

Japanese Patent Application Publication, Tokukaihei No. 10-064358 (Publication date: Mar. 6, 1998)

SUMMARY OF INVENTION

Technical Problem

In order to increase the variety of designs of illumination of the surrounding part, there has been a demand for increase in amount of light illuminating the surrounding part.

The present invention has been attained in view of the above problem, and an object of the present invention is to provide a push-button switch that increases an amount of light illuminating lateral sides of an operation button.

Solution to Problem

An illuminated push-button switch in accordance with the present invention is an illuminated push-button switch adapted such that, once a user presses an operation button, a switch body performs an operation, and light from at least one light source passes through a transmission plate and then illuminates the operation button, and in order to solve the above problem, the illuminated push-button switch includes: a first structure, provided on one side of the transmission plate which side faces the light source, operative to refract the light from the light source so that the refracted light is reflected within the transmission plate and then guided to a circumferential part of the transmission plate.

According to the above arrangement, light from the light source is refracted by the structure, and the refracted light is reflected within the transmission plate and then guided to the circumferential part of the transmission plate. The above arrangement, by virtue of utilizing refraction rather than reflection, allows the structure to be provided in a region to which light from the light source is directly projected. This makes it possible to increase the amount of light propagating toward lateral sides of the transmission plate, thus increasing the amount of light illuminating the lateral sides of the operation button.

Advantageous Effects of Invention

As described above, the illuminated push-button switch in accordance with the present invention, by virtue of utilizing refraction rather than reflection, allows the structure to be provided in a region to which light from the light source is directly projected. Hence, the illuminated push-button switch in accordance with the present invention yields the effect of increasing the amount of light propagating toward the lateral sides of the transmission plate and thus increasing the amount of light illuminating the lateral sides of the operation button.

Figure 7:
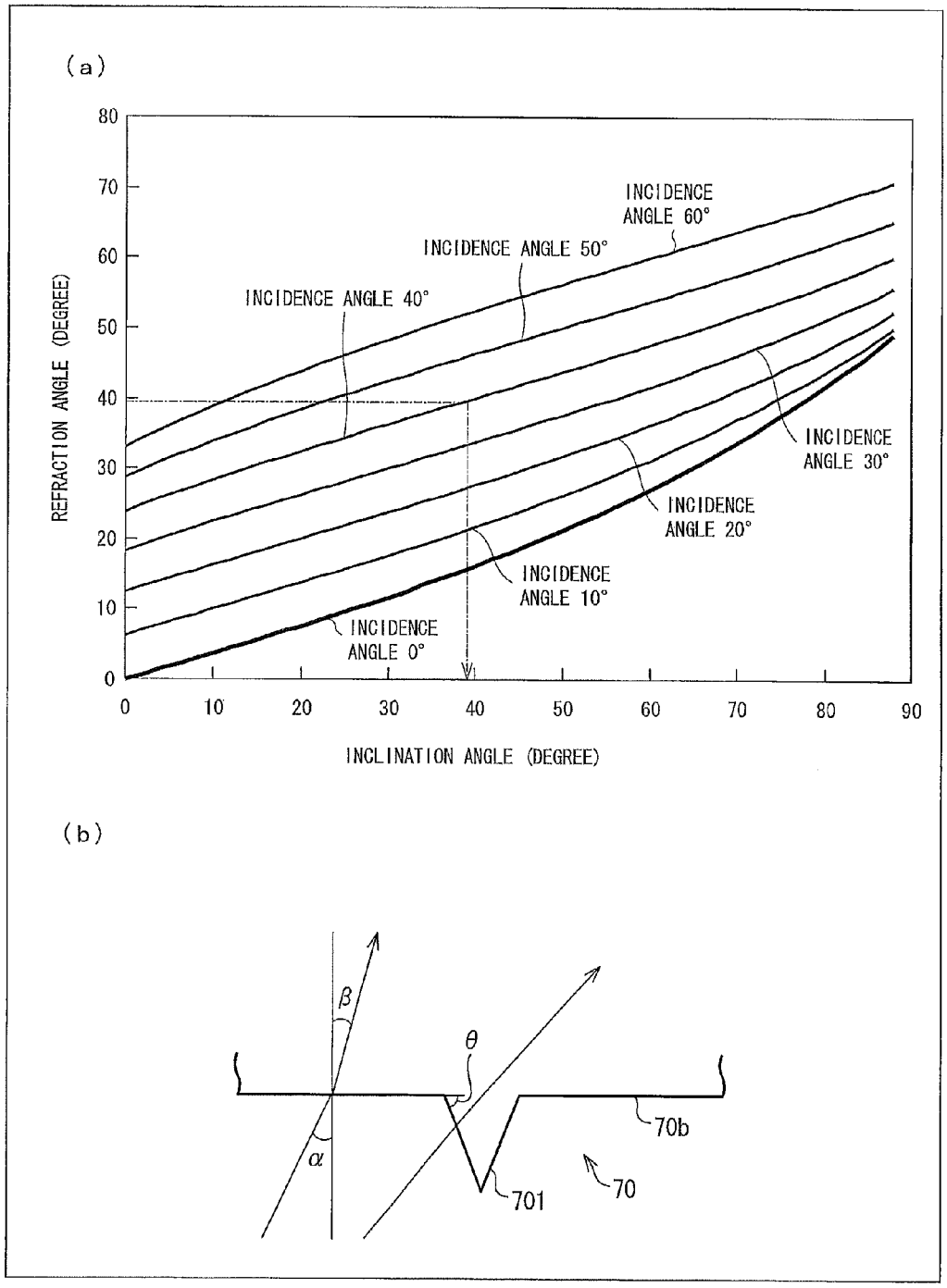

(a) of FIG. 7 is a graph showing what direction light incident upon the transmission plate is refracted in by inclination of the protrusion, and (b) of FIG. 7 is a schematic view for explaining an incidence angle $\alpha$ and a refraction angle $\beta$ in the graph of (a) of FIG. 7.

Figure 8:
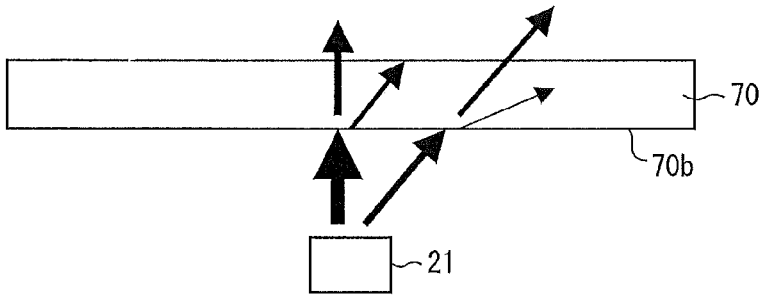

FIG. 8 is a schematic view illustrating the effect yielded by size variation of the protrusion.

Figure 9:
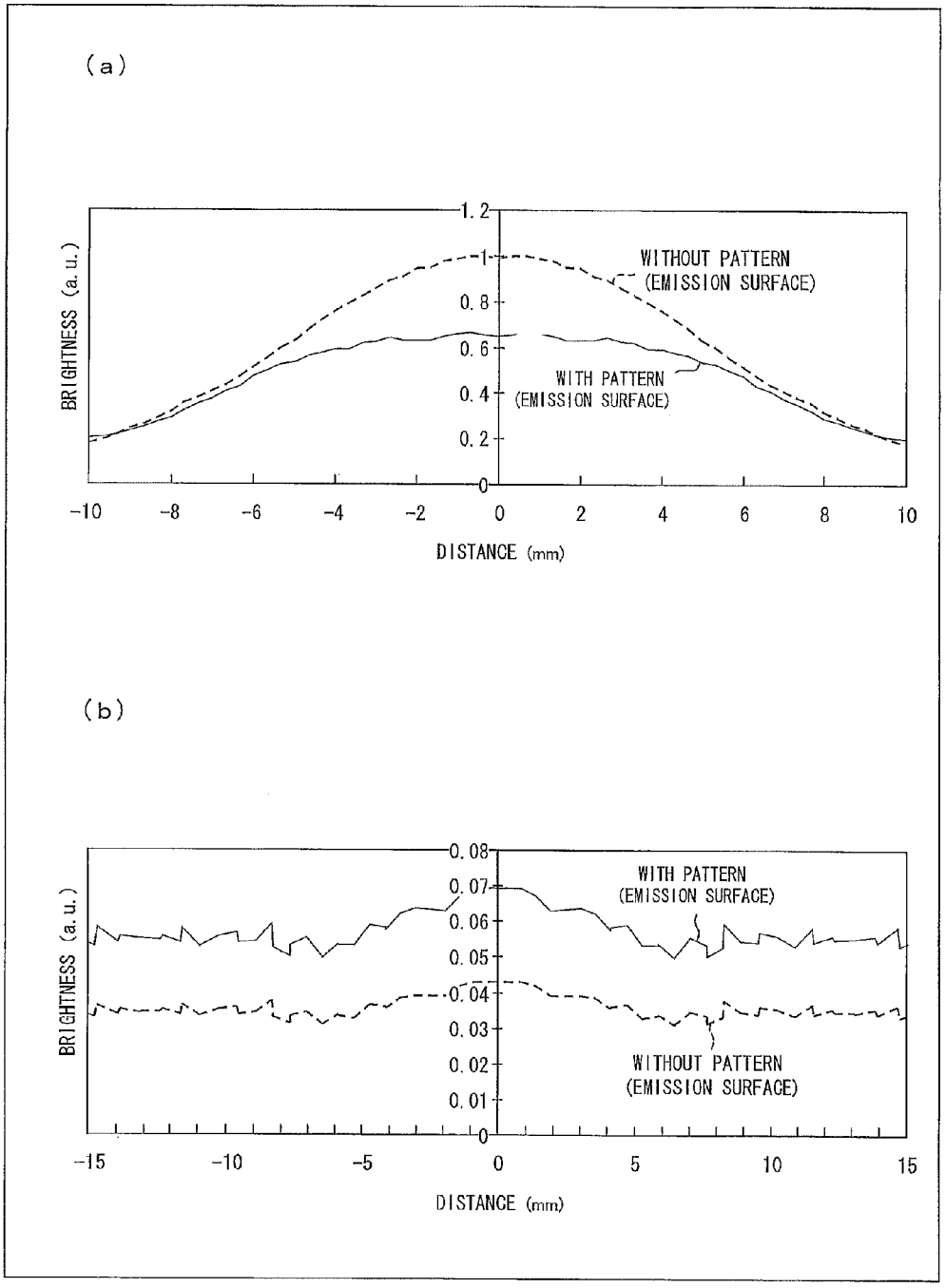

FIG. 9 is graphs each showing distribution of the amount of light directed into an operation button of the push-button switch.

Figure 10:
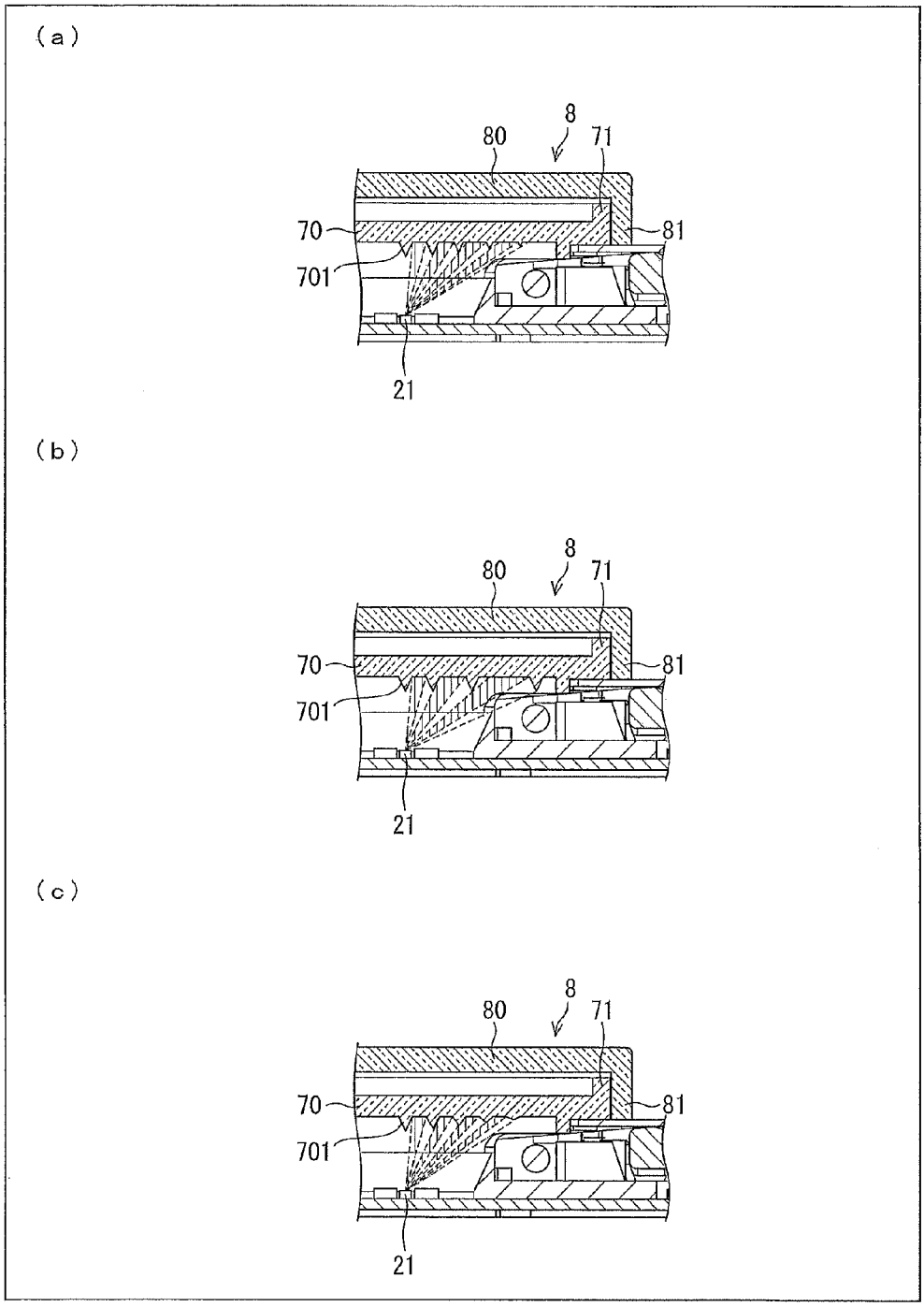

FIG. 10 is a cross-sectional view illustrating shape and disposition examples of the protrusions.

Figure 11:
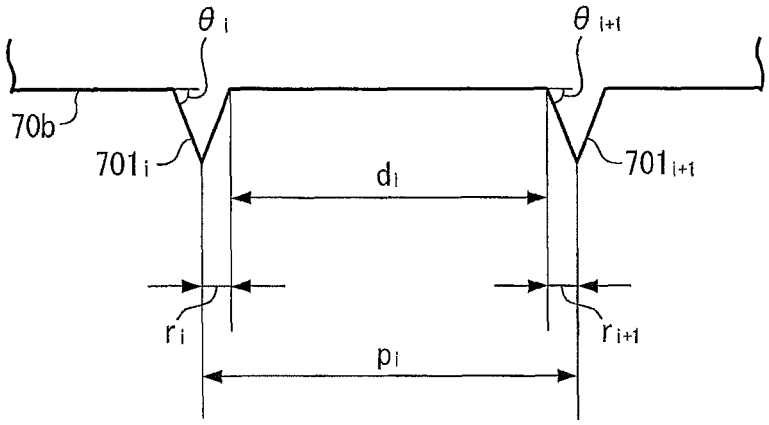

FIG. 11 is a cross-sectional view for explaining details of a pitch interval average inclination angle.

Figure 12:
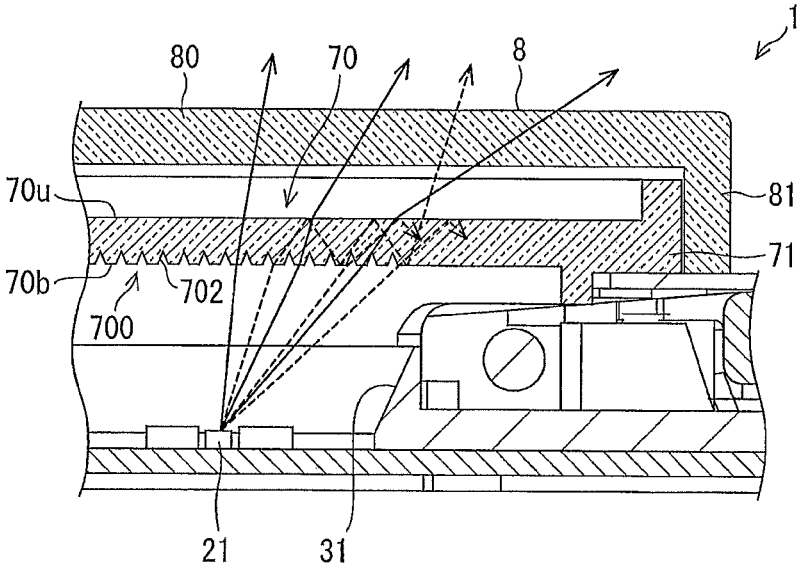

FIG. 12 is a cross-sectional view illustrating a modification example of the structure.

Figure 13:
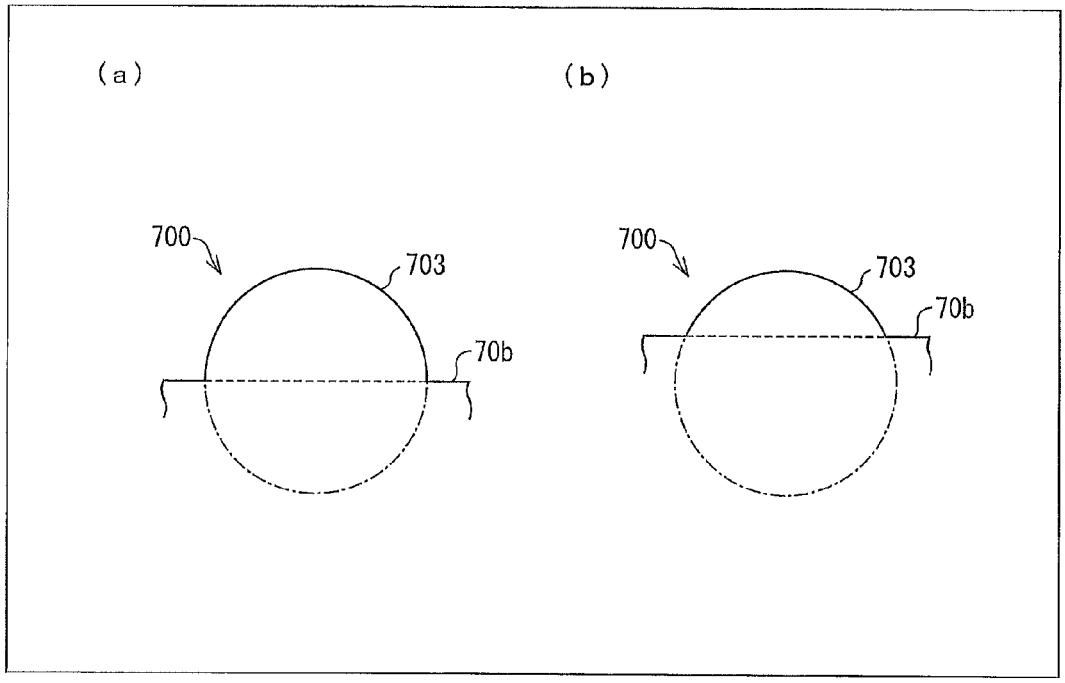

FIG. 13 is a schematic view illustrating another modification example of the structure.

Figure 14:
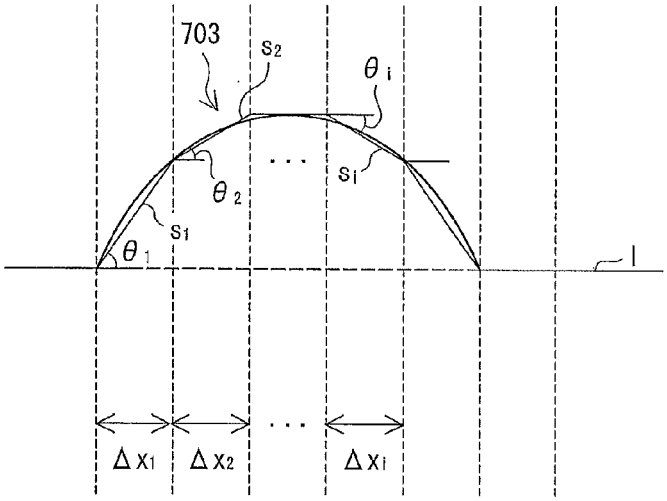

FIG. 14 is a cross-sectional view of the protrusion which is taken on a straight line included in a bottom surface of the protrusion of the structure and passing through the center of the bottom surface of the protrusion.

Figure 15:
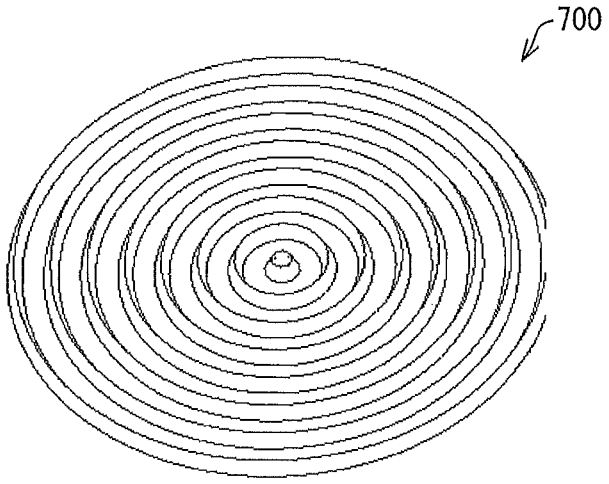

FIG. 15 is a perspective view illustrating another modification example of the structure.

Figure 16:
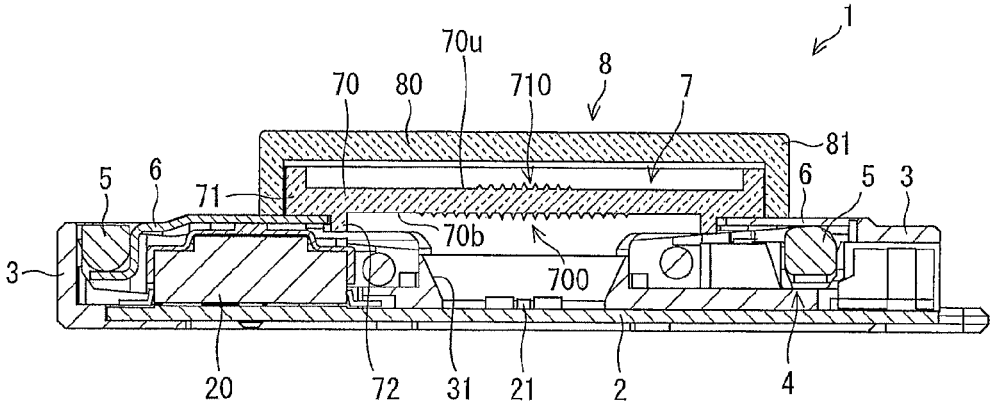

FIG. 16 is a cross-sectional view of a push-button switch in accordance with another embodiment of the present invention.

Figure 17:
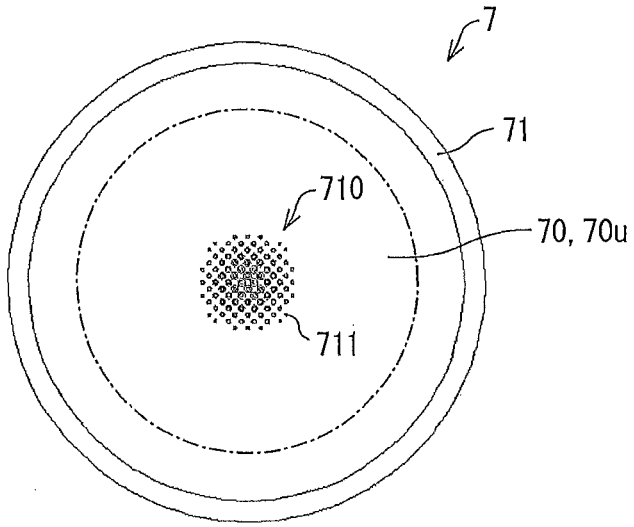

FIG. 17 is a plan view of a plunger provided in the push-button switch.

Figure 18:
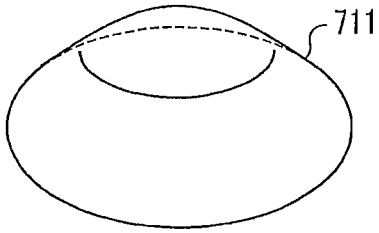

FIG. 18 is a perspective view illustrating the shape of a protrusion of a structure which is provided on an upper surface of a transmission plate of the plunger.

Figure 19:
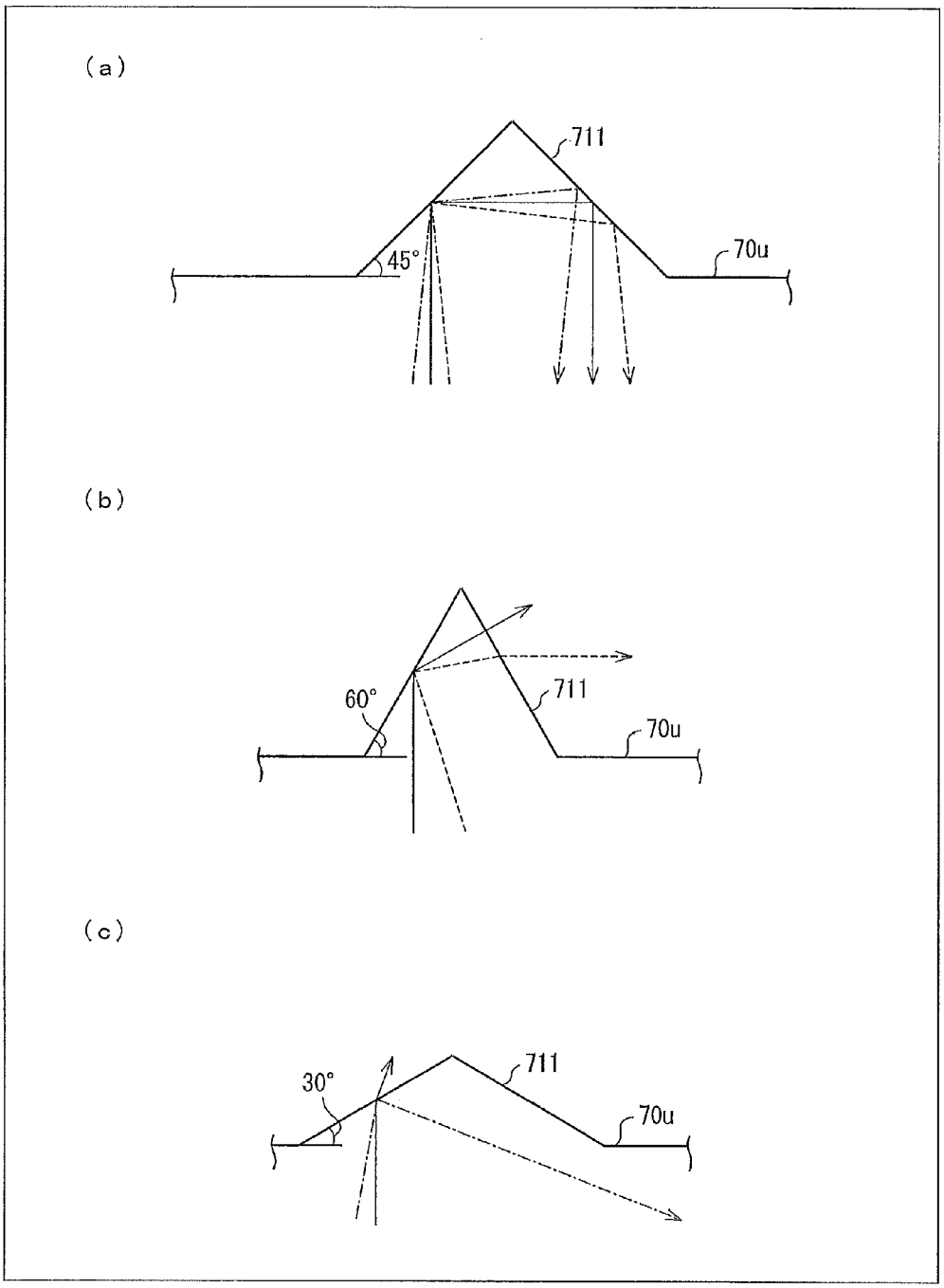

FIG. 19 is a schematic view illustrating how the structure changes propagation of light.

Figure 20:
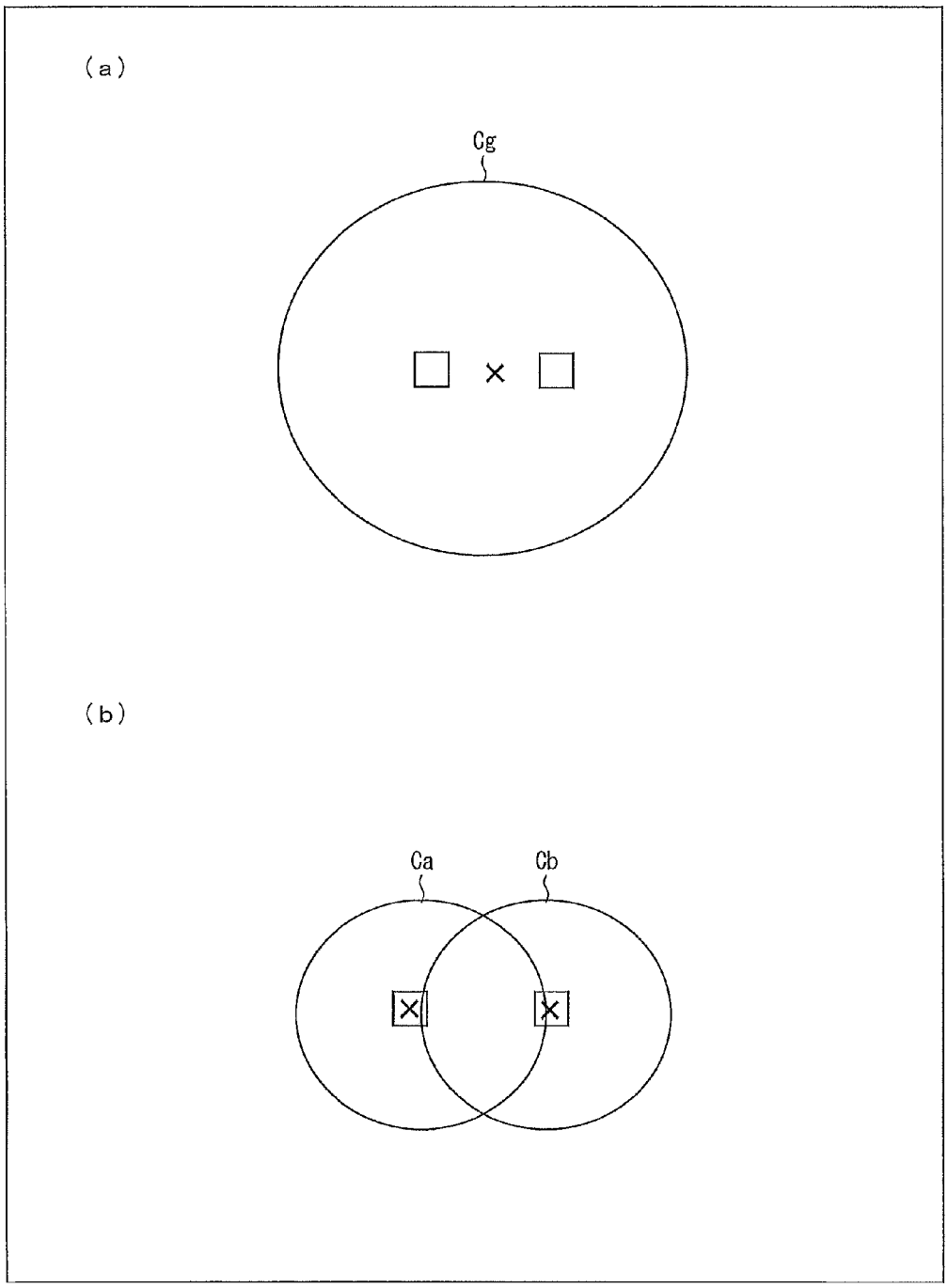

FIG. 20 is a schematic view illustrating examples of areas where the structures are provided, when two LEDs are employed, in a push-button switch in accordance with another embodiment of the present invention.

Figure 21:
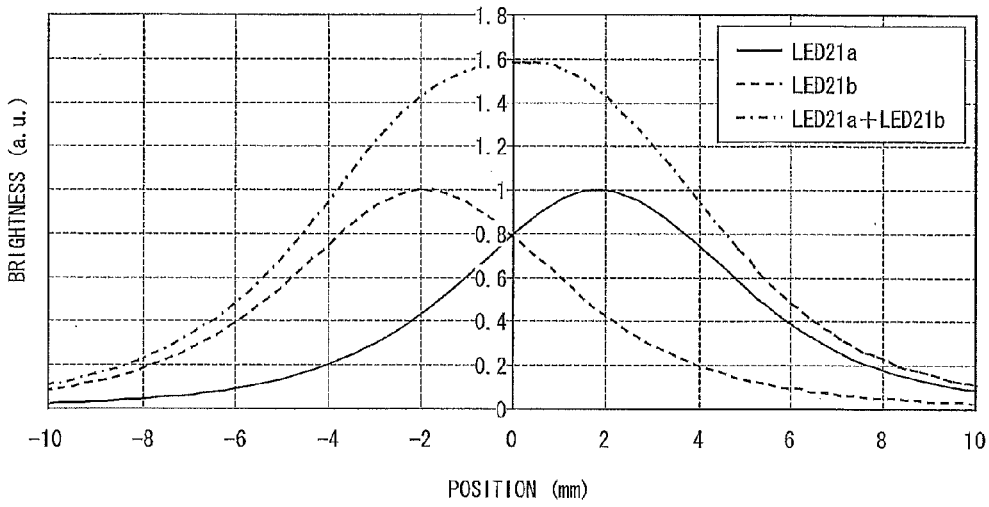

FIG. 21 is a graph showing distribution of the amount of light directed into a lower surface of a transmission plate of a plunger provided in the push-button switch, with respect to the respective amounts of light beams from the two LEDs and the amount of light from a combination of these LEDs.

Figure 22:
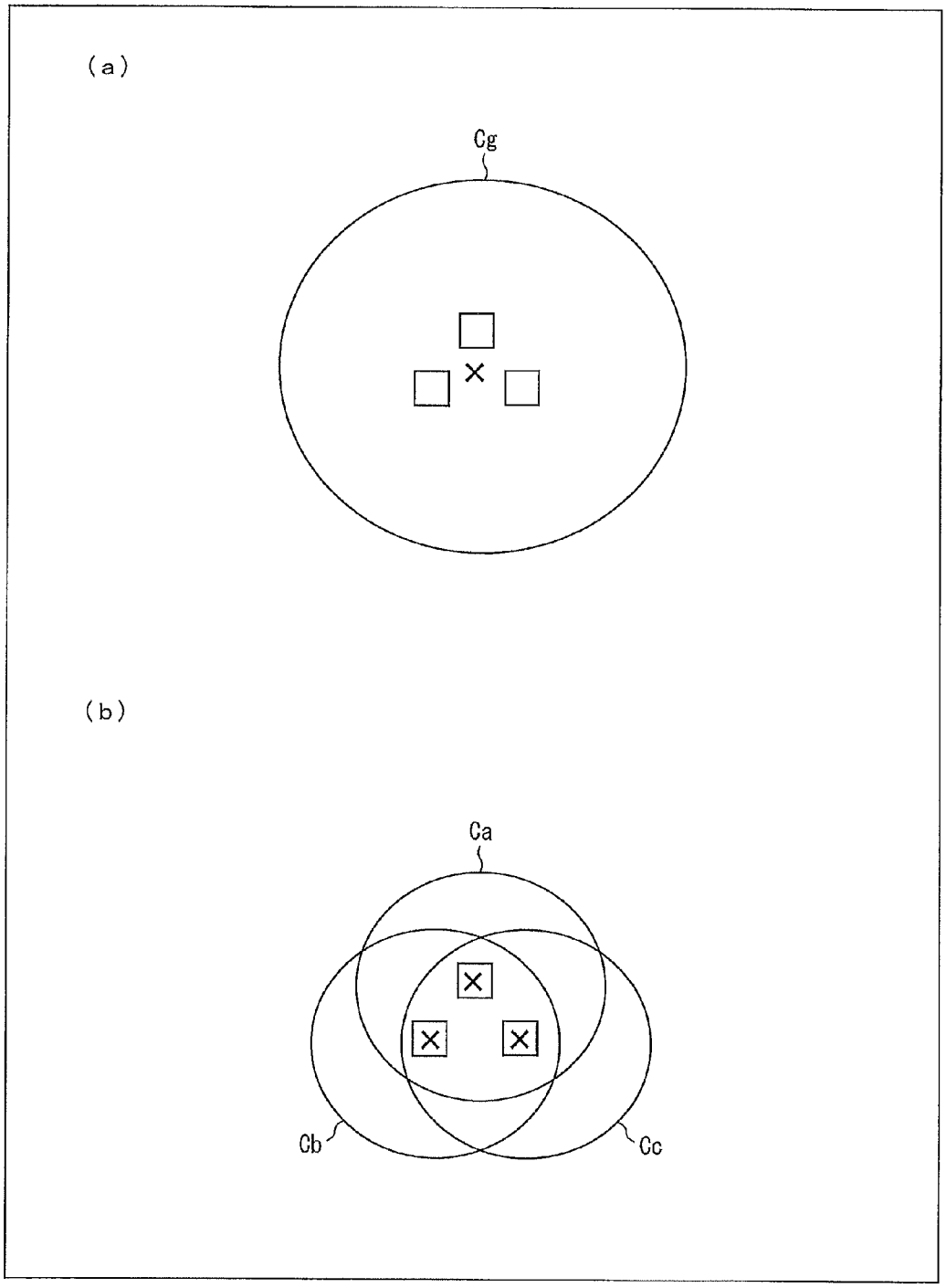

FIG. 22 is a schematic view illustrating examples of areas where the structures are provided, when three LEDs are employed, in the push-button switch.

Figure 23:
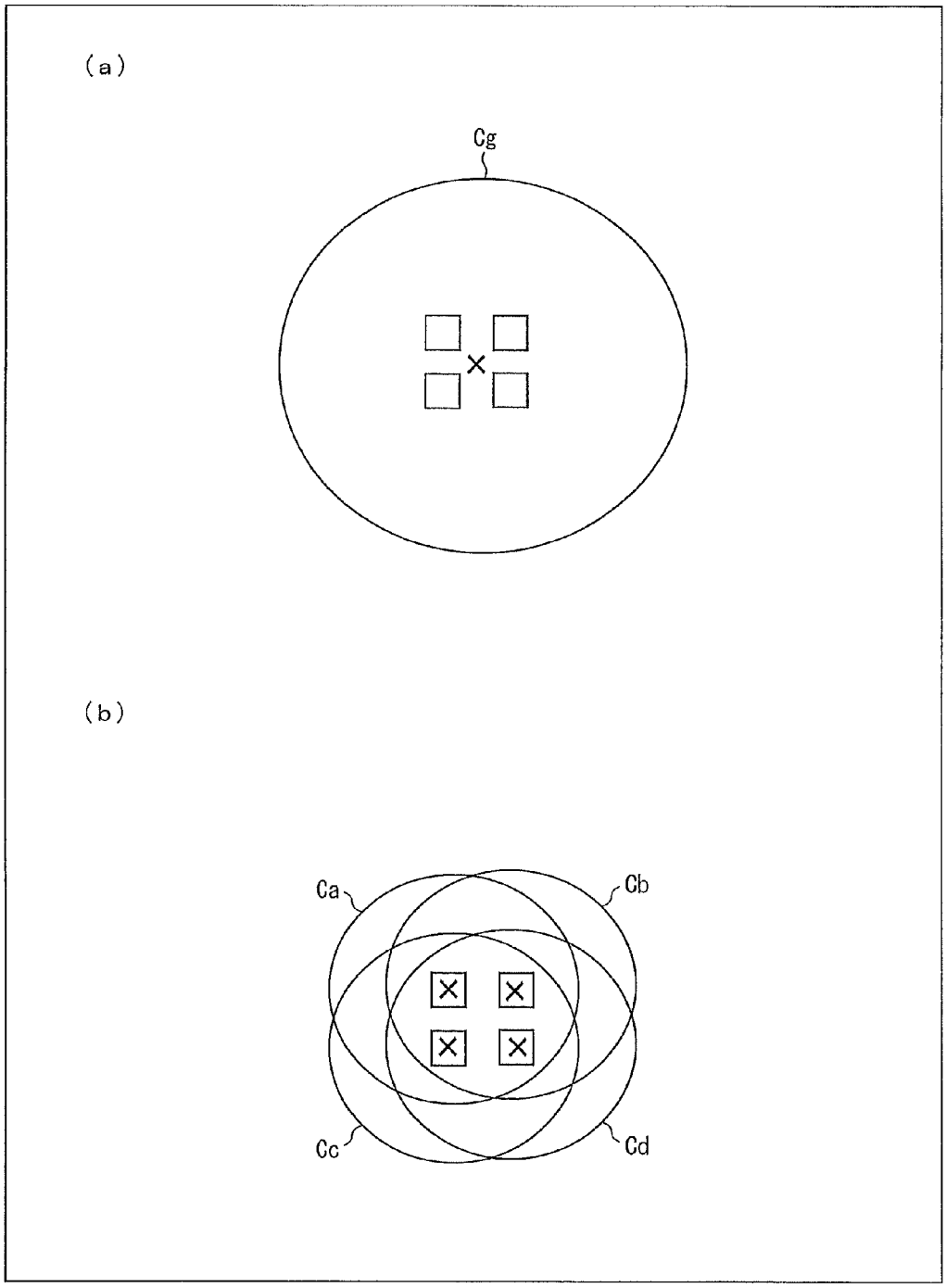

FIG. 23 is a schematic view illustrating examples of areas where the structures are provided, when four LEDs are employed, in the push-button switch.

DESCRIPTION OF EMBODIMENTS

[Embodiment 1]

Figure 1:
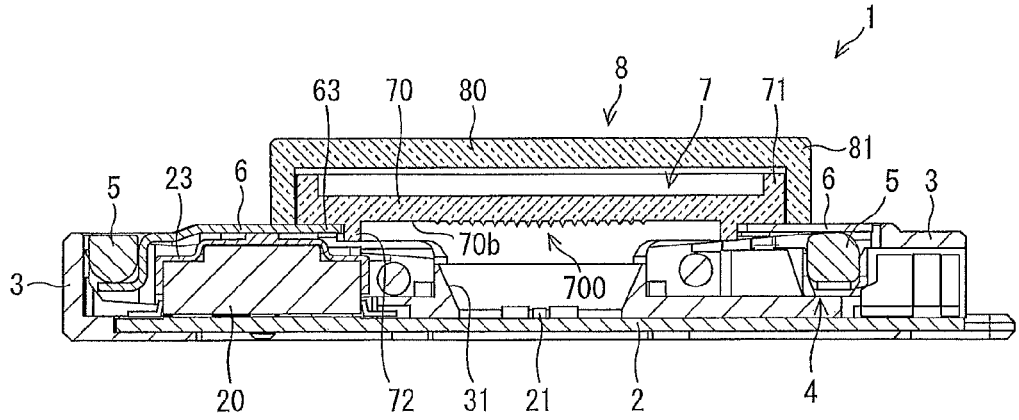
FIG. 1 is a cross-sectional view of an illuminated push-button switch in accordance with an embodiment of the present invention.
Figure 2:
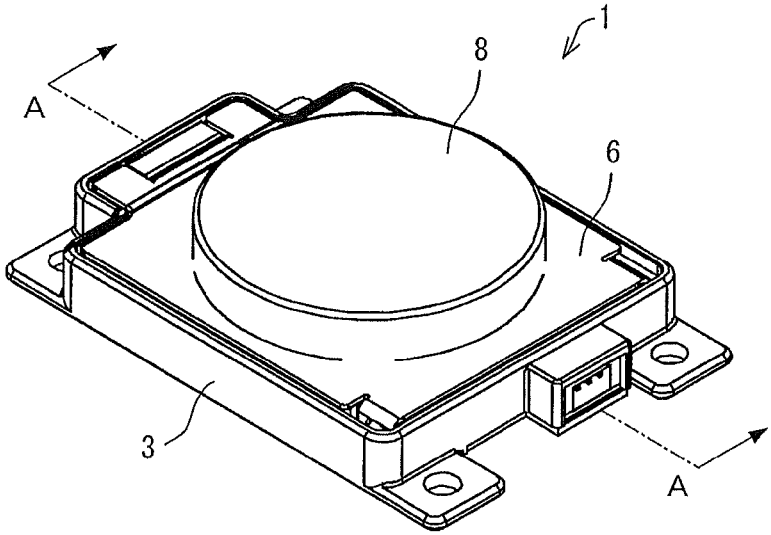
FIG. 2 is a perspective view illustrating an overview of the illuminated push-button switch.
Figure 3:
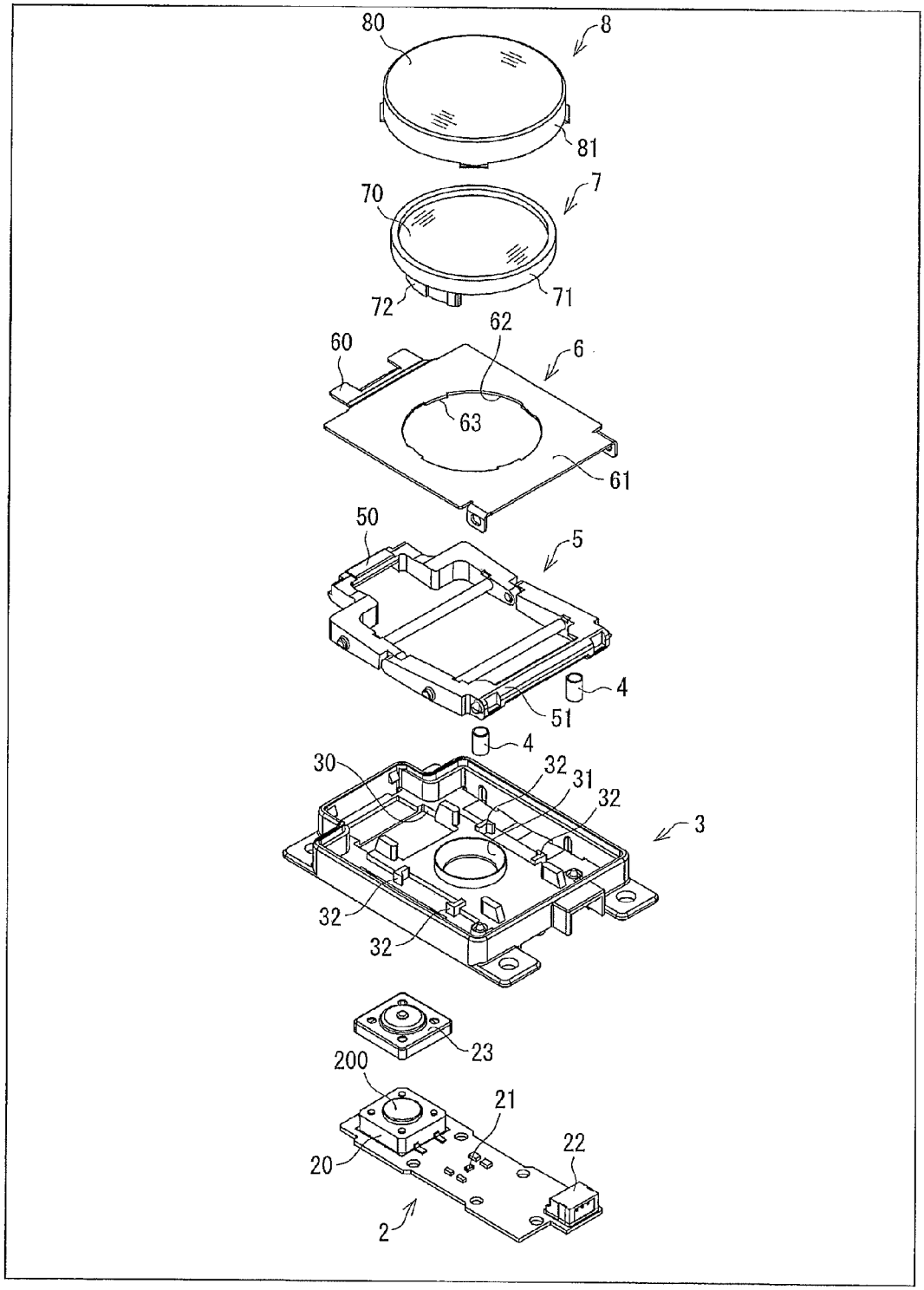
FIG. 3 is an exploded view of the illuminated push-button switch.

The following will describe an embodiment of the present invention with reference to FIGS. 1 through 15. FIG. 2 is a perspective view illustrating an overview of an illuminated push-button switch in accordance with the present embodiment. FIG. 3 is an exploded view of the illuminated push-button switch. FIG. 1 is a cross-sectional view taken from a line A-A of FIG. 2.

An illuminated push-button switch 1 in accordance with the present embodiment is used as, for example, an instruction switch, provided on an elevator operating panel mounted into a wall of an elevator hall, for providing an instruction to ascend, an instruction to descend, and other instructions. It should be noted that the illuminated push-button switch 1 will be hereinafter abbreviated to "push-button switch 1".

As illustrated in FIGS. 1 through 3, the push-button switch 1 is configured to include a printed board 2 on a lower surface of a base member 3 and to include a spring 4, a link mechanism 5, a movable cover 6, a plunger 7, and an operation button 8 in this order on an upper surface of the base member 3.

The printed board 2 is shaped like a long plate. On an upper surface of the printed board 2, a switch body 20, a chip-shaped LED 21 which serves as a light source for illumination, and a connector 22 are mounted at a front end part, at a central part, and at a base end part thereof, respectively. The switch body 20 includes a push button 200 provided on the upper surface, and a cushion rubber 23 is provided so as to cover the upper surface of the switch body 20.

The base member 3 has openings 30 and 31 respectively provided in regions thereof corresponding to the switch body 20 and the LED 21 of the printed board 2. With this arrangement, the switch body 20 is in contact with the movable cover 6 through the cushion rubber 23 while threading through the opening 30. Further, light from the LED 21 passes through the opening 31 and illuminates upwardly. Still further, the base member 3 has many engagement pieces 32, which are provided so as to extend upwardly, for allowing engagements with various members.

The link mechanism 5, which is a structure shaped like a frame and including two levers, is configured such that a front end part 50 and a base end part 51 move upward and downward in synchronization with each other. Further two springs 4 are provided between the base end part 50 of the link mechanism 5 and the base member 3.

The movable cover 6 is a plate-shaped member covering the link mechanism 5 therewith and is configured such that a front end part 60 and a base end 61 are engaged with the front end part 50 and the base end part 51 of the link mechanism 5, respectively. This arrangement allows the movable cover 6 to move upward and downward together with the front end part 50 and the base end part 51 of the link mechanism 5. Further, the movable cover 6 has a round opening 62 in a center thereof, wherein the opening 62 has four locking pieces 63, which extend button 8.

The plunger 7 has a circular transmission plate 70, wherein an upper circumferential wall 71 extends upward at a position on a circumference of an upper surface of the transmission plate 70, and a lower circumferential wall 72 extends downward at a position slightly inward from a circumference of a lower surface of the transmission plate 70. The lower circumferential wall 72 has a structure such that the lower circumferential wall 72 fits over the locking piece 63 of the movable cover 6. Further, a part of the lower circumferential wall 72 extends downward so as to be engaged with the engagement pieces 32 of the base member 3. This limits movements of the plunger 7 to upward and downward movements.

The operation button 8 has a circular transmission plate 80, wherein a circumferential wall 81 extends downward from a circumference of the transmission plate 80, and the upper circumferential wall 71 of the plunger 7 fits into an inside of the circumferential wall 81. This limits movements of the operation button 8 to upward and downward movements (movements in a direction in which the operation button 8 is pressed). Further, the circumferential wall 81 has four locking pieces 82, which extend outward from an end of the circumferential wall 81, for locking the movable cover 6. Note that an upper surface of the transmission plate 80 serves as an operating surface which is operated by a user.

Note that the plunger 7 and the operation button 8 are formed of a transparent material such as polycarbonate or acrylic. Further, the plunger 7 is preferably high in light transmittance. Meanwhile, light transmittance of the operation button 8 is selected as appropriate in terms of an illumination-based spatial design.

According to the push-button switch 1 configured as above, when a user presses the operation button 8 with his/her thumb and/or finger(s) or with some kind of means, the operation button 8 and the movable cover 6 move downward by virtue of the plunger 7 and the link mechanism 5. This causes the movable cover 6 to press the push button 200 of the switch body 20 through the cushion rubber 23, thereby causing the switch body 20 to perform a switch operation such as a switch-on operation.

In a case where power is externally supplied through a connector 22 to the components mounted on the printed board 2, the LED 21 emits light in accordance with the switch operation of the switch body 20 or in accordance with an instruction provided externally. At this time, the light from the LED 21 passes through the opening 31 of the base member 3, and the opening 62 of the movable cover 6, and the plunger 7 and then illuminates the operation button 8.

When the user removes his/her thumb and/or finger(s) or the means from the operation button 8, the link mechanism 5 moves upward by virtue of a restoring force of the springs 4. This, in turn, causes the movable cover 6, the plunger 7, and the operation button 8 to move upward into their original positions.

In the present embodiment, as illustrated in FIG. 1, the plunger 7 is arranged such that a structure 700 for refracting light from the LED 21 is provided on a lower surface 70*b* of the transmission plate 70 of the plunger 7, i.e., on a surface of the transmission plate 70 which surface faces the LED 21. The light refracted by the structure 700 is reflected within the transmission plate 70 and then guided to the upper circumferential wall 71 serving as a circumferential part. The present embodiment, by virtue of utilizing refraction rather than reflection, allows the structure 700 to be provided in a region to which the light from the LED 21 is directly projected. This makes it possible to increase the amount of light propagating toward the upper circumferential wall 71, thus increasing the amount of light illuminating the circumferential wall 81 of the operation button 8.

Note that, in order to allow the light from the LED 21 to be efficiently directed upward, the opening 31 of the base member 3 is preferably formed in a tapered shape in which a diameter of the opening 31 increases as it goes upward. Further, a surface forming the tapered shape is preferably formed like a mirror. Similarly, the printed board 2 preferably includes a plate-shaped mirror member provided in a vicinity of the LED 21.

Figure 4:
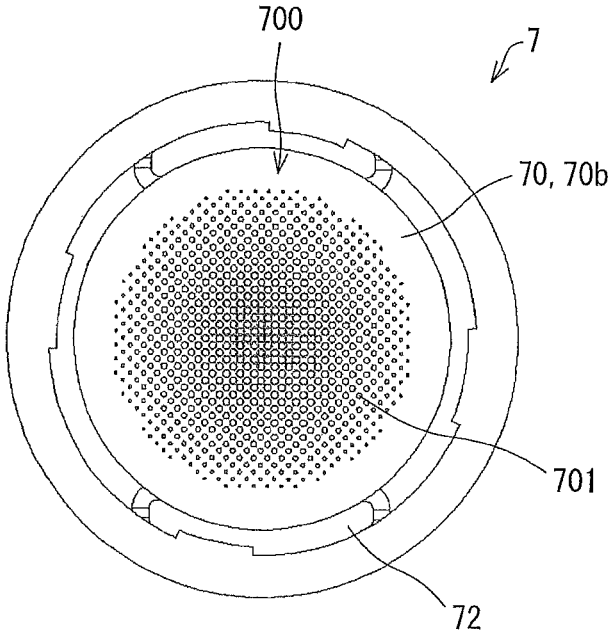
FIG. 4 is a bottom view of a plunger provided in the illuminated push-button switch.

The following will describe details of the structure 700. FIG. 4 is a bottom view of the plunger 7. In an example illustrated in FIG. 4, the structure 700 has many protrusions (uneven parts) 701 disposed in a staggered manner on the lower surface 70*b* of the transmission plate 70. Note that a region where the protrusions 701 are provided is preferably as large as possible and is therefore preferably a region into which the light from the LED 21 is directed. Further, the region where the protrusions 701 are provided is a circular region of 10 mm in radius in the example illustrated in FIG. 4. The region, however, can be determined as appropriate according to the size of a light source, positional relationships between the light source and optical components, directivity of the light source, and other factors.

Figure 5:
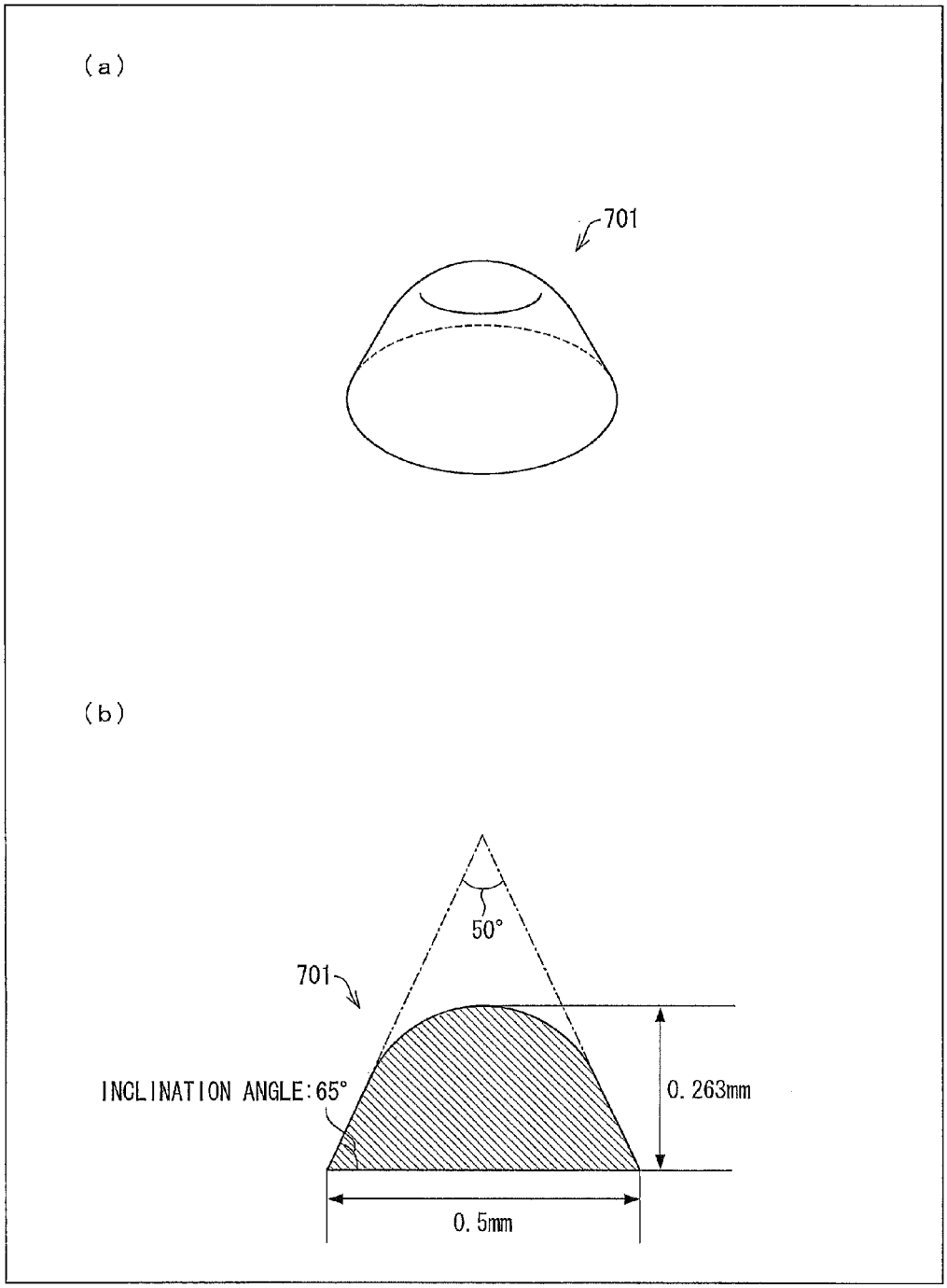
FIG. 5 is a perspective view illustrating the shape of protrusions of a structure which is provided on a lower surface of a transmission plate of the plunger.

FIG. 5 indicates the shape of the protrusion 701, wherein (a) of FIG. 5 is a perspective view of the protrusion 701, and (b) of FIG. 5 is a cross-sectional view of the protrusion 701. As illustrated in FIG. 5, the protrusion 701 is in the shape of a cone with a rounded tip. Such a shape allows for ease of processing and strength of the protrusion 701. This, however, is not the only possibility. Alternatively, the protrusion 701 may have a pointed tip.

Further, in the example illustrated in FIG. 5, the protrusion 701 is 65 degrees in inclination angle θ. The inclination angle is an angle formed between the bottom surface (the lower surface 70*b* of the transmission plate 70) and a generatrix of the cone. Further, the protrusions 701 measure, at maximum, as follows: 0.5 mm in diameter of the bottom surface; 0.263 mm in height; and 0.2 mm in curvature radius of the rounded tip.

Figure 6:
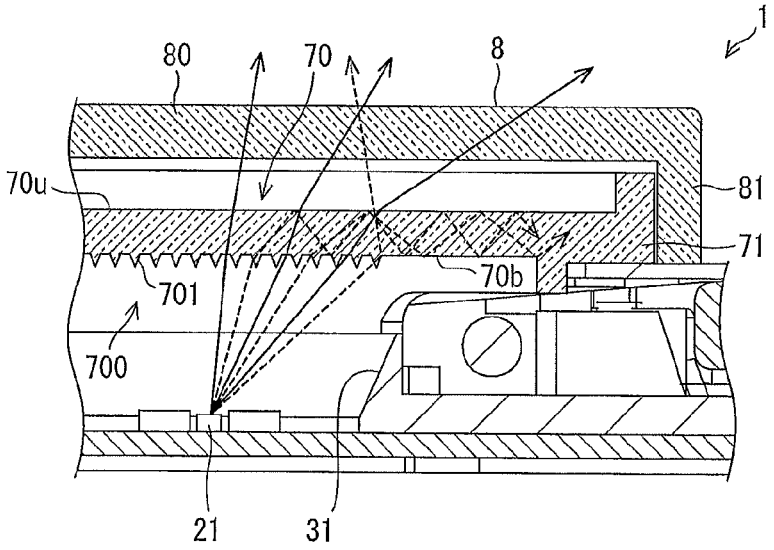
FIG. 6 is a schematic view illustrating how the structure changes propagation of light.

FIG. 6 is an enlarged view of the main part in FIG. 1 and illustrates how the structure 700 illustrated in FIGS. 4 and 5 effects propagation of light from the LED 21. In FIG. 6, a solid line indicates a light beam passing through the lower surface 70*b* of the transmission plate 70 and a dot-and-dash line indicates a light beam passing through the protrusion 701.

As illustrated in FIG. 6, since light incident upon the lower surface 70*b* of the transmission plate 70 is refracted upward, the light is refracted by the upper surface 70*u* of the transmission plate 70 and then passes through the upper surface 70*u* of the transmission plate 70, and, as a result, the light reaches the transmission plate 80 of the operation button 8. On the other hand, light incident upon the protrusion 701 of the transmission plate 70 is refracted toward lateral sides of the transmission plate 70. If the light refracted toward the lateral sides enters the upper surface 70*u* of the transmission plate 70 at an incidence angle that is equal to or higher than a critical angle of total reflection, the refracted light is subjected to total reflection within the transmission plate 70 and reaches the upper circumferential wall 71.

Thus, it can be understood that the provision of the protrusion 701 on the lower surface 70*b* of the transmission plate 70 increases the amount of light illuminating the circumferential wall 81 of the operation button 8. Since the protrusions 701 are disposed discretely, it can also be understood that light passing through the lower surface 70*b* of the transmission plate 70 illuminates the transmission plate 80 of the operation button 8.

Further, the protrusion 701 has the pointed tip in FIG. 6. With reference to FIG. 6, the light passing through a vicinity of an apex of the protrusion 701 enters again a conical surface of the protrusion 701, subjected to total reflection, and then reaches the transmission plate 80 of the operation button 8. From this, it can be considered that whether the protrusion 701 is pointed or rounded has little influence on the amount of light illuminating the circumferential wall 81 of the operation button 8.

Next, the following will describe a preferable range of the inclination angle θ. (a) of FIG. 7 is a graph showing results obtained from simulations on what direction light incident upon the transmission plate 70 is refracted in by inclination of the protrusion 701. Note that a material for the transmission plate 70 is polycarbonate. (b) of FIG. 7 is a schematic view for explaining an incidence angle α and a refraction angle β in the graph of (a) of FIG. 7. As illustrated in (b) of FIG. 7, it is assumed that the incidence angle α is an angle formed between a normal to the lower surface 70*b* of the transmission plate 70 and a direction in which light enters the lower surface 70*b* of the transmission plate 70, and the refraction angle β is an angle formed between the normal to the lower surface 70*b* of the transmission plate 70 and a direction in which light refracts within the transmission plate 70. It is also assumed that the lower surface 70*b* of the transmission plate 70 is at 0 degree in inclination angle θ.

With reference to the graph shown in (a) of FIG. 7, it can be understood that the refraction angle β increases with increase in inclination angle θ. It can also be understood that the refraction angle β increases with increase in incidence angle α. In order to guide light to the lateral sides of the transmission plate 70, the refraction angle β should be equal to or higher than a critical angle of total reflection. In a case where polycarbonate is employed, the critical angle is 39 degrees. Further, the amount of light decreases with increase in incidence angle α. In order that light in a certain amount reaches the lateral sides of the transmission plate 70, the use of light having an incidence angle α of not lower than 40 degrees, which light has a high intensity to some extent, is considered. In order that this light reaches the lateral sides of the transmission plate 70, the refraction angle β needs to be not lower than 39 degrees. Consequently, it can be understood, from the graph shown in (a) of FIG. 7, that the inclination angle θ should be not lower than 40 degrees.

On the other hand, the protrusion 701 having a too sharp tip, i.e., a too small apex angle results in a low light intensity. In view of this, the apex angle is preferably high. In other words, a small inclination angle θ is desired. Previous studies have demonstrated that the use of polycarbonate having an apex angle of 50 degrees at the lowest (inclination angle θ of 65 degrees at the highest) causes no problems. Further, in a case where acrylic or other firm material is employed for the transmission plate 70, no problem occurs even when the apex angle of such a material is in the order of 30 degrees (angle θ of inclination of 75 degrees). Thus, it can be understood that the inclination angle 8 is preferably in a range from 40 degrees to 75 degrees, particularly preferably approximately 65 degrees. Furthermore, a rounded tip of the protrusion 701 as illustrated in FIG. 5 can prevent weakening of the strength of the protrusion 701.

Further, in the present embodiment, the sizes of the protrusions 701 decrease with increasing distance from the center of the transmission plate 70, as illustrated in FIG. 4. FIG. 8 is a schematic view illustrating the effect yielded by such size variation of the protrusions 701. FIG. 8 indicates that the thicker an arrow is, the larger (higher) the amount of light (light intensity) is.

As illustrated in FIG. 8, light from the LED (light source) 21 is directed toward the center of the transmission plate 70. For this reason, a large amount of light is directed into the center part of the transmission plate 70 whereas a small amount of light is directed into the circumferential part of the transmission plate 70.

As can be understood from FIG. 4, the proportion of the protrusions 701 per unit area of the transmission plate 70 is high in the center part of the transmission plate 70 whereas the proportion is low in the circumferential part of the transmission plate 70. Hence, the proportion of light directed into the protrusions 701 is high in the center part of the transmission plate 70, which in turn increases the proportion of light directed toward the lateral sides of the transmission plate 70. In contrast, the proportion of light directed into the protrusions 701 is low in the circumferential part of the transmission plate 70, which in turn decreases the proportion of light directed to the lateral sides of the transmission plate 70. With this arrangement, light passing through the transmission plate 70 and then being directed into the transmission plate 80 of the operation button 8 is reduced in amount of light directed into the center part of the transmission plate 80 and is maintained or increased in amount of light directed to the circumferential part of the transmission plate 80. This enables improvement in evenness.

FIG. 9 is graphs each showing results obtained from simulations on distribution of the amount of light directed into the operation button 8 of the push-button switch 1. In the graph in FIG. 9, a solid line indicates the present embodiment, and a broken line indicates a comparative embodiment. In the comparative embodiment, the structure 700 is removed from the push-button switch 1 in accordance with the present embodiment.

A graph in (a) of FIG. 9 shows distribution of the amount of light directed into the transmission plate 80 of the operation button 8. In the graph, a vertical axis indicates brightness, and a horizontal axis indicates a distance from the center of the transmission plate 80 on a line passing through the center of the transmission plate 80. A graph in (b) of FIG. 9 shows the amount of light illuminating the circumferential wall 81 of the operation button 8. In the graph, a vertical axis indicates brightness, and a horizontal axis indicates a distance from a certain point on a perimeter of the circumferential wall 81.

With reference to FIG. 9, the push-button switch 1 of the present embodiment, as compared to the push-button switch of the comparative embodiment, suppresses the amount of light directed into the center part of the transmission plate 80 and maintains the amount of light directed into the circumferential part of the transmission plate 80. From this result, it can be understood that the push-button switch 1 of the present embodiment provides improvement in evenness. It can also be understood that the push-button switch 1 of the present embodiment offers an 1.8-fold increase in amount of light directed into the circumferential wall 81 while maintaining uniformity.

In the example of FIG. 4, the sizes of the protrusions 701 decrease with increasing distance from the center of the transmission plate 70. Alternative varying shapes and dispositions of the protrusions 701 can be considered. FIG. 10 is an enlarged view of the main part in FIG. 1 and shows shapes and dispositions of the protrusions 701 in accordance with the present embodiment. Note that FIG. 10 displays the protrusions 701 in an exaggerated manner. Further, a hatch pattern with longitudinal lines in FIG. 10 indicates light directed into the lower surface **70*b* of the transmission plate 70 without being directed into on the protrusions 701 of the transmission plate 70, out of the light from the LED 21**.

The protrusions 701 illustrated in (a) of FIG. 10 are provided at uniform intervals, as in the case with the protrusions 701 illustrated in FIG. 4. The protrusions 701 illustrated in (a) of FIG. 10, however, decrease in size with increasing distance from the LED 21. With reference to (a) of FIG. 10, it can be understood that with increasing distance from the LED 21, a light-receiving region of the lower surface **70*b* of the transmission plate 70 gets larger than that of the protrusions 701 of the transmission plate 70, and the shapes and dispositions of the protrusions 701 illustrated in (a) of FIG. 10 therefore yield the effects shown in FIGS. 8 and 9**.

The protrusions 701 illustrated in (b) of FIG. 10 are identical in size to one another, but are provided at intervals that increase with increasing distance from the LED 21. With reference to (b) of FIG. 10, it can be understood that with increasing distance from the LED 21, a light-receiving region of the lower surface **70*b* of the transmission plate 70 gets larger than that of the protrusions 701 of the transmission plate 70, and the shapes and dispositions of the protrusions 701 illustrated in (b) of FIG. 10 therefore yield the effects shown in FIGS. 8 and 9**.

The protrusions 701 illustrated in (c) of FIG. 10 are provided at uniform intervals, but decrease in inclination angle θ with increasing distance from the LED 21. With reference to (c) of FIG. 10, it can be understood that, even with increasing distance from the LED 21, there is no difference between a light-receiving region of the lower surface 70*b* of the transmission plate 70 and a light-receiving region of the protrusion 701 of the transmission plate 70.

In contrast, with reference to the graph in (a) of FIG. 7, the refraction angle β decreases with decreasing the inclination angle θ. That is, the proportion of light directed toward the lateral sides of the transmission plate 70 decreases. Thus, in a case where the protrusions 701 illustrated in (c) of FIG. 10 are employed, the proportion of light directed toward the lateral sides of the transmission plate 70 decreases with increasing distance from the LED 21. This means that the shapes and dispositions of the protrusions 701 illustrated in (c) of FIG. 10 yield effects similar to the effects shown in FIGS. 8 and 9.

The shapes and dispositions of the protrusions 701 in (a) to (c) of FIG. 10 are generalized as follows. That is, assuming that 0 represents an inclination angle of the protrusions 701, and the bottom surface 70*b* is 0 degree in inclination angle, an average value of magnitudes (absolute values) of the inclination angle at a pitch interval between the protrusions 701, i.e. at a distance from a center of a certain protrusion 701 to a center of an adjacent protrusion 701 is defined as a pitch interval average inclination angle.

FIG. 11 is a cross-sectional view for explaining details of the pitch interval average inclination angle. As shown in FIG. 11, as to adjacent protrusions $\mathbf{701}_i$ and $\mathbf{701}_{i+1}$, their inclination angles are denoted by $\theta_1$ and $\theta_{i+1}$, respectively, their bottom surface radii are denoted by $r_i$ and $r_{i+1}$, respectively, and an interval between the protrusions $\mathbf{701}_i$ and $\mathbf{701}_{i+1}$ is denoted by di. At this time, a pitch pi is expressed by $p_i=r_i+d_i+r_{i+1}$, and the pitch interval average inclination angle avg_pitch $(\theta)_i$ is expressed by the following equation:

$$\text{avg_pitch}(\theta)_i=(|\theta_i|\times r_i+0\times d_i+|\theta_{i+1}|\times r_{i+1})/p_i \quad (1).$$

From the above equation (1), it can be understood that in order to decrease the pitch interval average inclination angle avg_pitch $(\theta)_i$, the adjacent protrusions $\mathbf{701}_i$ and $\mathbf{701}_{i+1}$ should be arranged by any of the followings: increasing the pitch pi as shown in (b) of FIG. 10, decreasing the radii $r_i$ and $r_{i+1}$ of the bottom surfaces, i.e. sizes of the protrusions, as shown in (a) of FIG. 10, and decreasing the inclination angles $\theta_i$ and $\theta_{i+1}$, as shown in (c) of FIG. 10.

Consequently, it can be understood that effects similar to the effects shown in FIGS. 8 and 9 are yielded by the protrusions 701 formed and disposed such that the pitch interval average inclination angle decreases with increasing distance from the LED 21, i.e. with increasing distance from the center of the transmission plate 70.

In the present embodiment, the protrusions 701 are disposed in a staggered pattern. This, however, is not the only possibility. Alternatively, the protrusions 701 can be disposed in a radial pattern, in a spiral pattern, in a concentric pattern, in a random pattern, or in any other pattern, provided that the protrusions 701 are disposed discretely. The conical protrusions 701 employed in the present embodiment can be replaced by protrusions 701 of any other shape, such as a pyramid, with inclined surfaces.

Next, the following will describe modification examples of the structure 700 in accordance with the present embodiment with reference to FIGS. 12 through 15. FIG. 12 is a cross-sectional view of the main part in FIG. 1 and illustrates a modification example of the structure 700 in accordance with the present embodiment. In the example illustrated in FIG. 12, the structure 700 includes many recesses (uneven parts) 702, instead of many protrusions 701.

As illustrated in FIG. 12, the recesses 702 allow light to be directed toward the lateral sides in a manner similar to the protrusions 701 and can therefore yield effects similar to the effects shown in FIGS. 8 and 9. In a case where the transmission plate 70 is prepared by cutting, the recesses 702 are formed more easily than the protrusions 701. On the other hand, in a case where the transmission plate 70 is prepared by molding, a mold for the transmission plate 70 with the recesses 702 is easier to manufacture than a mold for the transmission plate 70 with the protrusions 701. Note that the transmission plate 70 may be provided with both the recesses 702 and the protrusions 701.

FIG. 13 is a schematic view illustrating another modification example of the structure 700 in accordance with the present embodiment. In the example shown in (a) and (b) of FIG. 13, the shape of the protrusion 703 is, instead of a cone, a part of a sphere (a hemisphere in (a) of FIG. 13 and a part of a hemisphere in (b) of FIG. 13). In this case, the processing of the protrusion 703 is easily processable.

Note that, for the protrusion 703 of the shape as illustrated in FIG. 13 with varying inclinations, the inclination angle θ can be evaluated as follows: FIG. 14 is a cross-sectional view of the protrusion 703 which is taken on a straight line included in a bottom surface of the protrusion 703 and passing through the center of the bottom surface of the protrusion 703. As illustrated in FIG. 14, a cross section of the protrusion 703 is subdivided into segments along a line 1, and an angle formed between a line $s_i$ connecting intersection points and the line 1 in one of the segments is denoted by an inclination angle $\theta_i$ of that segment. Then, an average value (θ) of magnitudes (absolute values) of inclination angles of all of the segments is calculated by the following equation:

$$\text{avg}(\theta)=\Sigma(|\theta_i|\times\Delta x_i)/\Sigma\Delta x_i \quad (2).$$

The calculated average value is evaluated as the inclination angle θ of the protrusion 703.

In the example of FIG. 13, the protrusion 703 is a hemisphere or a part of the hemisphere and can be expressed by an equation. In this case, the equation (2) can be rewritten into the integration form and calculated. As a result, for example, in a case where the protrusion 703 is a hemisphere as illustrated in (a) of FIG. 13, the average value avg(θ) is 45 degrees. Further, when the protrusion 703 is a part of a hemisphere as illustrated in (b) of FIG. 13, the average value avg(B) is calculated by the following equation:

$$\tan(\text{avg}(\theta))=\{a-(a^2-b^2)^{1/2}\}/b \quad (3),$$

wherein a represents a radius of the hemisphere, and b represents a radius of the bottom surface of the protrusion 703.

FIG. 15 is a perspective view illustrating another modification example of the structure 700 in accordance with the present embodiment. In the example illustrated in FIG. 15, the structure 700 is composed of objects each shaped like a triangle revolving about a normal to the transmission plate 70, the normal passing through the center of the transmission plate 70, wherein the objects are disposed concentrically from the center of the transmission plate 70. Also in this case, a base angle of the triangle is the inclination angle θ, and it is possible to yield effects similar to the effects shown in FIGS. 8 and 9. Thus, the structure 700 may be continuous structural objects being disposed discretely.

[Embodiment 2]

Next, the following will describe another embodiment of the present invention with reference to FIGS. 16 through 19. FIG. 16 is a cross-sectional view illustrating a schematic configuration of a push-button switch 1 in accordance with the present embodiment. The push-button switch 1 illustrated in FIG. 16 is identical to the push-button switch 1 illustrated in FIG. 1, except that a structure 710 for reflecting light emitted from the LED 21 and transmitted by the transmission plate 70 is additionally provided on the upper surface 70*u* of the transmission plate 70 of the plunger 7, that is, on a surface of the transmission plate 70 which surface faces the operation button 8. Note that members described in Embodiment 2 that are identical in function to their respective corresponding members described in Embodiment 1 are each assigned a common reference numeral, and are not described here.

The following will describe details of the structure 710. FIG. 17 is a plan view of the plunger 7. Note that a region surrounded by a dot-and-dash line in FIG. 17 indicates a region where the protrusions 701 are provided on the lower surface 70*b* of the transmission plate 70.

In an example illustrated in FIG. 17, the structure 710 has many protrusions (uneven parts) 711 provided in a staggered manner on the upper surface 70*u* of the transmission plate 70. Note that, as illustrated in FIG. 17, a region where the protrusions 711 are provided should be a region where the amount of light passing through the transmission plate 70 is large, i.e. a central region of the transmission plate 70 in FIG. 9. Further, the region where the protrusions 711 are provided is a circular region of 3 mm in radius in the example illustrated in FIG. 17. The region, however, can be determined as appropriate according to the size of a light source, positional relationships between the light source and optical components, directivity of the light source, a variation in distribution of the amount of light received by the structure 700 provided on the lower surface 70*b* of the transmission plate 70, and other factors.

As illustrated in FIG. 17, the region where the protrusions 711 of the structure 710 are provided is preferably smaller than the region where the protrusions 701 of the structure 700 are provided. Particularly, it is preferable that a radius of the circular region where the protrusions 711 are provided is equal to or less than half the radius of the circular region where the protrusions 701 are provided.

FIG. 18 is a perspective view illustrating the shape of the protrusion 711. The protrusion 711 illustrated in FIG. 18 is identical in shape to the protrusion 701 illustrated in FIG. 5, except that the inclination angle θ of the protrusion 711 is lower than that of the protrusion 701. In the example illustrated in FIG. 18, the protrusion 711 is 45 degrees in inclination angle θ. Further, the protrusions 711 measure, at maximum, as follows: 0.5 mm in diameter of the bottom surface; 0.13 mm in height; and 0.2 mm in curvature radius of the rounded tip.

FIG. 19 is a schematic view illustrating how the structure 710 illustrated in FIGS. 17 and 18 effects propagation of light from the LED 21. (a) through (c) of FIG. 19 illustrate how the light from the LED 21 propagates when the inclination angle θ is 45 degrees, 60 degrees, and degrees, respectively. Note that a material for the transmission plate 70 is polycarbonate.

In a case where the inclination angle θ is 45 degrees as illustrated in (a) of FIG. 19, light propagating the transmission plate 70 is subjected twice to total reflection by the protrusion 711 provided on the upper surface 70*u* and then goes back to the lower surface 70*b*. This makes it possible to further suppress the amount of light in the center part of the transmission plate 80 of the operation button 8 and further improve evenness in amount of light illuminating the transmission plate 80.

In a case where the inclination angle θ is 60 degrees as illustrated in (b) of FIG. 19, light propagating through the transmission plate 70 is subjected to total reflection and refracted by the protrusion 711 provided on the upper surface 70*u* and then exits from the protrusion 711 toward the lateral sides of the transmission plate 70. In a case where the inclination angle θ is 30 degrees as illustrated in (c) of FIG. 19, a portion of light propagating the transmission plate 70 is reflected by the protrusion 711 provided on the upper surface 70*u* and then propagates toward the lateral sides of the transmission plate 70, while the other portion of the light propagating through the transmission plate 70 is refracted by the protrusion 711 and then exits from the protrusion 711 toward above in a slanting direction. These arrangements make it possible to suppress the amount of light in the center part of the transmission plate 80 of the operation button 8 and improve evenness in amount of light illuminating the transmission plate 80.

Thus, it can be understood that the protrusion 711 provided on the upper surface 70*u* of the transmission plate 70 is preferably in a range from 30 degrees to 60 degrees in inclination angle θ, particularly preferably approximately 45 degrees. It can also be understood that, considering that the protrusion 701 provided on the lower surface 70*b* of the transmission plate 70 is particularly preferably approximately 65 degrees, the protrusion 711 provided on the upper surface 70*u* is preferably smaller in inclination angle θ than the protrusion 701 provided on the lower surface 70*b*. As in the arrangement illustrated in FIG. 10, the protrusions 711 may be provided and disposed such that the pitch interval average inclination angle decreases with increasing distance from the LED 21, i.e. with increasing distance from the center of the transmission plate 70.

Note that although the structure 710 employed in the present embodiment is made up of many protrusions 711 arranged, the structure 710 can be replaced by a structure similar to any of the structures 700 illustrated in FIGS. 12 through 15.

[Embodiment 3]

Next, the following will describe another embodiment in accordance with the present invention with reference to FIGS. 20 through 23. A push-button switch 1 in accordance with the present embodiment is identical to the push-button switch 1 illustrated in FIG. 1, except that a plurality of LEDs 21 are used as a light source for illumination, and the structures 700 and 710 of the transmission plate 70 are provided in different areas accordingly. Increasing the number of light sources enables improvement in brightness of the push-button switch 1. Note that members described in Embodiment 3 that are identical in function to their respective corresponding members described in Embodiments 1 and 2 are each assigned a common reference numeral, and are not described here.

FIG. 20 is a schematic view illustrating examples of areas where the structures 700 and 710 are provided when two LEDs 21*a* and 21*b* are employed. (a) of FIG. 20 illustrates an example in which the center of a circular area Cg having the structures 700 and 710 provided therein coincides with a midpoint between centers of two light-receiving regions of the transmission plate 70, the light-receiving regions receiving respective light beams from the two these LEDs 21. (b) of FIG. 20 illustrates an example in which centers of circular areas Ca and Cb, where the respective structures 700 and 710 are provided, coincide respectively with the centers of the above two light-receiving regions. In FIG. 20, the centers of these two light-receiving regions are each indicated by a hollow square, and the centers of the circular areas Cg, Ca, and Cb are each indicated by a cross mark.

FIG. 21 is a graph showing distribution of the amount of light directed into the lower surface 70*b* of the transmission plate 70, with respect to the respective amounts of light beams from the two LEDs 21*a* and 21*b* and the amount of light from a combination of these LEDs 21*a* and 21*b*. In the graph of FIG. 21, a vertical axis indicates brightness, and a horizontal axis indicates a distance from the center of the lower surface 70*b* of the transmission plate 70 on a line passing through the center of the lower surface 70*b*.

With reference to FIGS. 20 and 21, it is apparent that, in the arrangement illustrated in (a) of FIG. 20, the structures 700 and 710 are provided in the circular area Cg, wherein the center of the circular area Cg coincides with a position at which the amount of light from the combination of the LEDs 21*a* and 21*b* is a maximum value. It is also apparent that, in the arrangement illustrated in (b) of FIG. 20, the structures 700 and 710 are provided respectively in the circular areas Ca and Cb, wherein the centers of the circular areas Ca and Cb coincide with respective positions at which the amounts of light beams from the LEDs 21*a* and 21*b* are maximum values. In any of these arrangements, the structures 700 and 710 are disposed in such a manner their centers coincide with the bright positions. These arrangements therefore enable yielding effects similar to the effects yielded by the foregoing embodiment in which the single LED 21 is employed.

Note that the structure 700 provided on the lower surface 70*b* of the transmission plate 70 is intended to guide light beams entering the transmission plate 70 from the LEDs 21*a* and 21*b*, toward the lateral sides of the transmission plate 70. For this reason, the area where the structure 700 is provided is preferably of the shape illustrated in (a) of FIG. 20. Further, the structure 710 formed on the upper surface 70*u* of the transmission plate 70 is intended to suppress the amount of light exiting from the transmission plate 70. For this reason, the area where the structure 710 is provided is preferably of the shape illustrated in (b) of FIG. 20. In fact, excellent results were obtained from the above simulations performed for these arrangements. The shapes of the areas where the structures 700 and 710 are provided, however, may be a uniform shape which is selected from the shapes illustrated in (a) and (b) of FIG. 20.

Alternatively, in a case where three or more LEDs 21 are employed, the areas where the structures 700 and 710 are provided are based on a combination of midpoints each of which is a midpoint between the centers of any two of the light-receiving regions corresponding to the LEDs 21, but these areas may be preferably based on a centroid of the centers of all of the light-receiving regions corresponding to the three LEDs 21.

FIG. 22 is a schematic view illustrating an example of areas where the structures 700 and 710 are provided when three LEDs 21 are employed. (a) of FIG. 22 illustrates an example in which the center of a circular area Cg having the structures 700 and 710 provided therein coincides with a centroid of centers of three light-receiving regions of the transmission plate 70, the light-receiving regions receiving respective light beams from the three LEDs 21. (b) of FIG. 22 illustrates an example in which centers of circular areas Ca to Cc, where the respective structures 700 and 710 are provided, coincide respectively with the centers of the above three light-receiving regions. In FIG. 20, the centers of these three light-receiving regions are each indicated by a hollow square, and the centers of the circular areas Cg, Ca, Cb, and Cc are each indicated by a cross mark.

FIG. 23 is a schematic view illustrating an example of areas where the structures 700 and 710 are provided when four LEDs 21 are employed. (a) of FIG. 23 illustrates an example in which the center of a circular area Cg having the structures 700 and 710 provided therein coincides with a centroid of centers of four light-receiving regions of the transmission plate 70, the light-receiving regions receiving respective light beams from the four LEDs 21. (b) of FIG. 23 illustrates an example in which centers of circular areas Ca to Cd, where the respective structures 700 and 710 are provided, coincide respectively with the centers of the above four light-receiving regions. In FIG. 23, the centers of these four light-receiving regions are each indicated by a hollow square, and the centers of the circular areas Cg, Ca, Cb, Cc, and Cd are each indicated by a cross mark.

The present invention is not limited to the descriptions of the Embodiments, but can be altered by a person skilled in the art within the scope of the claims. An embodiment derived from a proper combination of technical means disclosed in different embodiments is also encompassed in the technical scope of the present invention.

The above embodiment employs the arrangement in which the transmission plate 70 of the plunger 7 is provided with the structures 700 and 710. An alternative arrangement may be employed, for example, in which two separate transmission plates respectively having the structures 700 and 710 are prepared and then applied respectively to the lower surface 70*b* and the upper surface 70*u* of the transmission plate 70. However, the arrangement in which the transmission plate 70 of the plunger 7 is provided with the structures 700 and 710 enables reduction in parts count and thus enables reduction of costs.

The above embodiment employs the arrangement in which the plunger 7 and the operation button 8 are separated from each other, but may be integral with each other. Further, the above embodiment uses the LED 21 as the light source for illumination, but the LED 21 may be replaced by an incandescent light bulb, lasers, and a fluorescent lamp, or any light source.

In the above embodiment, the operation button 8 and the transmission plate 70 are of a round shape, but may be of a rectangular shape or any other shape. In this case, the shape of the area where the structures 700 and 710 are provided is preferably arranged so as to be made identical to that shape.

As described above, an illuminated push-button switch in accordance with the present invention is an illuminated push-button switch adapted such that, once a user presses an operation button, a switch body performs an operation, and light from at least one light source passes through a transmission plate and then illuminates the operation button, and in order to solve the above problem, the illuminated push-button switch includes: a first structure, provided on one side of the transmission plate which side faces the light source, operative to refract the light from the light source so that the refracted light is reflected within the transmission plate and then guided to a circumferential part of the transmission plate.

According to the above arrangement, light from the light source is refracted by the first structure, and the refracted light is reflected within the transmission plate and then guided to the circumferential part of the transmission plate. The above arrangement, by virtue of utilizing refraction rather than reflection, allows the first structure to be provided in a region to which light from the light source is directly projected. This makes it possible to increase the amount of light propagating toward lateral sides of the transmission plate, thus increasing the amount of light illuminating the lateral sides of the operation button.

Note that the first structure may be integral with the transmission plate or may be provided independently of the transmission plate.

An illuminated push-button switch in accordance with the present invention is preferably arranged such that the first structure comprises uneven parts disposed discretely, the uneven parts being at least one of inclined protrusions and inclined recesses. With this arrangement, the light incident upon the area where the uneven parts are provided is guided to the circumferential part of the transmission plate, while the light incident upon the other area passes through the transmission plate and then reaches the operation button. This ensures adequate illumination of the operation button.

Note that examples of the uneven parts include a cone, a pyramid, a part of a sphere, and a revolution body shaped like a triangle, a circle, or the like object revolving around an axis.

An illuminated push-button switch in accordance with the present invention is preferably arranged such that the uneven parts are such that a pitch interval average inclination angle, which is an average value of magnitudes of inclination angles at an interval between the uneven parts adjacent to each other, decreases with increasing distance from a center of light directed into the transmission plate from the light source.

Specifically, the uneven parts are preferably such that sizes of the uneven parts decrease, intervals between the uneven parts increase, or inclination angles of the uneven parts decrease, with increasing distance from the center of light directed into the transmission plate from the light source.

Generally, as to the light emitted from the light source, light in a large amount is directed into the center part of the transmission plate, whereas light in a small amount is directed into the circumferential part of the transmission plate. On the other hand, according to the above arrangement, the proportion of light guided to the lateral sides by the first structure in the light directed into the center part of the transmission plate is higher than the proportion of light guided to the lateral sides by the first structure in the light directed into the circumferential part of the transmission plate. This allows the light to evenly pass through the transmission plate, thus evenly illuminating the operation button.

An illuminated push-button switch in accordance with the present invention is preferably such that the at least one light source comprises a plurality of light sources. This arrangement increases the amount of light incident upon the transmission plate, thus allowing the operating surface and lateral sides of the operation button to be more illuminated.

Note that it is preferable that a center of an area where the first structure is provided coincides with one of (i) centers of a plurality of light-receiving regions of the transmission plate, the light-receiving regions respectively receiving light beams from the plurality of light sources, and (ii) a midpoint between the centers of the plurality of light-receiving regions or a centroid of the centers of the plurality of light-receiving regions.

An illuminated push-button switch in accordance with the present invention is preferably such that a second structure operative to reflect or refract light exiting from the transmission plate is provided on another side of the transmission plate which side faces the operation button. This arrangement allows the light to evenly pass through the transmission plate, thus evenly illuminating the operation button.

The second structure provided on the other side of the transmission plate can be provided in a region of the transmission plate which region emits light in a large amount from the transmission plate. On the other hand, the first structure provided on the one side of the transmission plate is preferably provided in a region of the transmission plate which receives light from the light source.

Thus, the area having the second structure provided on the other side of the transmission plate can be smaller than the area having the first structure provided on the one side of the transmission plate.

Further, a center of the area having the first structure provided on the one side of the transmission plate coincides with the centroid of the centers of the plurality of light-receiving regions of the transmission plate, the light-receiving regions respectively receiving light beams from the plurality of light sources, while a center of the area having the second structure provided on the other side of the transmission plate coincides with the centers of the plurality of light-receiving regions of the transmission plate. Since the second structure provided on the other side of the transmission plate reflects or refracts light, the uneven parts of the second structure provided on the other side of the transmission plate can be lower in inclination angle than those of the first structure provided on the one side of the transmission plate.

An illuminated push-button switch in accordance with the present invention may be arranged such that the transmission plate is a part of a plunger for limiting a direction in which the operation button is pressed. This arrangement eliminates the need to additionally provide the transmission plate and thus enables reduction in manufacturing cost.

Note that an operating panel including the illuminated push-button switch arranged as above also yields the aforementioned effects. This realizes an operating panel that provides aesthetically designed illumination.

INDUSTRIAL APPLICABILITY

As described above, an illuminated push-button switch in accordance with the present invention can increase an amount of light illuminating side surfaces of an operation button and is therefore applicable to any illuminated button switch such as an illuminated touch button switch.

REFERENCE SIGNS LIST

1 Illuminated push-button switch
2 Printed board
3 Base member
4 Spring
5 Link mechanism
6 Movable cover
7 Plunger
8 Operation button
20 Switch body
21 LED (light source)
31 Opening
70 Transmission plate
**70*b*** Lower surface
**70*u*** Upper surface
71 Upper circumferential wall
72 Lower circumferential wall
80 Transmission plate
81 Circumferential wall

700, 710 Structure
701 Protrusion (uneven part)
702 Recess (uneven part)
703 Protrusion
710 Structure
711 Protrusion (uneven part)

The invention claimed is:

1. An illuminated push-button switch adapted such that, once a user presses an operation button, a switch body performs an operation, and light from at least one light source passes through a transmission plate and then illuminates the operation button, the illuminated push-button switch comprising:

a first structure, provided on one side of the transmission plate which side faces the light source, operative to refract the light from the light source so that the refracted light is reflected within the transmission plate and then guided to a circumferential part of the transmission plate, wherein the first structure comprises uneven parts, and an area which is not the uneven parts is provided between each adjacent ones of the uneven parts, the uneven parts being at least one of inclined protrusions and inclined recesses, and wherein the uneven parts are such that a pitch interval average inclination angle, which is an average value of magnitudes of inclination angles at an interval between the uneven parts adjacent to each other, decreases with increasing distance from a center of light directed into the transmission plate from the light source.

2. The illuminated push-button switch according to claim 1, wherein the uneven parts are such that sizes of the uneven parts decrease, intervals between the uneven parts increase, or inclination angles of the uneven parts decrease, with increasing distance from the center of light directed into the transmission plate from the light source.

3. The illuminated push-button switch according to claim 1, wherein said at least one light source comprises a plurality of light sources.

4. The illuminated push-button switch according to claim 3, wherein a center of an area where the first structure is provided coincides with one of (i) centers of a plurality of light-receiving regions of the transmission plate, the light-receiving regions respectively receiving light beams from the plurality of light sources, and (ii) a midpoint between the centers of the plurality of light-receiving regions or a centroid of the centers of the plurality of light-receiving regions.

5. The illuminated push-button switch according to claim 1, wherein a second structure operative to reflect or refract light exiting from the transmission plate is provided on another side of the transmission plate which side faces the operation button.

6. The illuminated push-button switch according to claim 5, wherein the area having the second structure provided on the other side of the transmission plate is smaller than the area having the first structure provided on the one side of the transmission plate.

7. The illuminated push-button switch according to claim 5, wherein the second structure comprises uneven parts disposed discretely, the uneven parts being at least one of inclined protrusions and inclined recesses, and the uneven parts of the second structure provided on the other side of the transmission plate are lower in inclination angle than those of the first structure provided on the one side of the transmission plate.

8. The illuminated push-button switch according to claim 5, wherein said at least one light source comprises a plurality of light sources, a center of the area having the first structure provided on the one side of the transmission plate coincides to the centroid of the centers of the plurality of light-receiving regions of the transmission plate, the light-receiving regions respectively receiving light beams from the plurality of light sources, and a center of the area having the second structure provided on the other side of the transmission plate coincides with the centers of the plurality of light-receiving regions of the transmission plate.

9. The illuminated push-button switch according to claim 1, wherein the transmission plate is a part of a plunger for limiting a direction in which the operation button is pressed.

10. An operating panel comprising the illuminated push-button switch according to claim 1.

* * * * *